US005263784A

United States Patent [19]

Nojima et al.

[11] Patent Number: 5,263,784

[45] Date of Patent: Nov. 23, 1993

[54] SHEET FEEDER FOR PRINTER

[75] Inventors: Masamitsu Nojima; Tadashi Mitsuhashi; Tomoo Ikeda; Kouji Hiruma, all of Saitama, Japan

[73] Assignee: Citizen Watch Co., Ltd., Tokyo, Japan

[21] Appl. No.: 867,057

[22] Filed: Apr. 10, 1992

[30] Foreign Application Priority Data

Apr. 12, 1991 [JP] Japan ..... 3-024260[U]
Apr. 16, 1991 [JP] Japan ..... 3-025612[U]

[51] Int. Cl.[5] ..... B41J 19/92

[52] U.S. Cl. ..... 400/570; 400/185; 400/568; 400/565; 400/567

[58] Field of Search ..... 400/185, 550, 553, 555, 400/565, 567, 568, 569, 570, 577, 578, 648, 649, 562, 902

[56] References Cited

FOREIGN PATENT DOCUMENTS 2490150 3/1982 France ..... 400/568
0173188 10/1982 Japan ..... 400/185
0000986 1/1985 Japan ..... 400/568
0125869 6/1986 Japan ..... 400/568
0189969 8/1986 Japan ..... 400/570

*Primary Examiner*—Edgar S. Burr
*Assistant Examiner*—Christopher A. Bennett
*Attorney, Agent, or Firm*—Fish & Richardson

[57] ABSTRACT

In a printer, a sheet feeder includes a motor which is used for a plurality of mechanisms in common so as to make the printer lighter in weight and more compact in size. The sheet feeder can vary the feeding amount of the sheet in response to the printing operation. The sheet feeder also permits the manual operation of a sheet feed roller shaft by disconnecting power from a motor via a power switching mechanism. The power switching mechanism includes a clutch mechanism which has a gear for transmitting the power of the motor, and a clutch wheel. The clutch mechanism is used when feeding the sheet by the operation of the motor. The sheet feeding amount is varied by the operation of a partial gear which comes into contact selectively with a first or second feed cam. These feed cams have projections having different heights.

4 Claims, 17 Drawing Sheets

SHEET FEEDER FOR PRINTER

BACKGROUND OF THE INVENTION

1. Field of Invention:

This invention relates to a sheet feeder for a printer, which is driven by a motor used also for a printing head moving mechanisms, and has a mechanism for varying the feeding amount of the paper sheet.

2. Description of the Related Art:

The printer plays an important role as one of the peripheral devices in computer and office automation systems.

The printer automatically feeds the paper sheet (called "sheet" hereinafter) when operated by the motor, and sometimes feeds the sheet in response to the user's manual request. Specifically, when printing is completed on one line, the sheet is automatically fed to another line by the operation of the motor. On the other hand, the sheet is fed by manually turning a sheet feed roller so as to load a sheet or to adjust a print start position.

Usually, a sheet feeding motor is independent from a motor for operating other mechanisms in the printer. A stepping motor or a servo-motor is widely used for this purpose, so that the sheet feeder can easily vary the feeding amount of the sheet as desired.

During normal operation, the printer alternately makes a printed record of information on one line and feeds the sheet to a predetermined extent. The printer also performs sheet feeding, but only when there is a blankline or when the printing is completed.

A sheet feeding mechanism normally begins feeding the sheet immediately after the printing is completed on one line. Specifically, the sheet is fed for one line space each time a printing head reciprocates once (this is called "printing cycle" hereinafter). On the other hand, when the printing head does not operate, such as for blanklines, the printer can feed the sheet to a desired extent contrary to the one-line-feed per printing cycle rule. It is possible to shorten the operating time of the printer if the sheet feeder is designed to feed three blank lines per printing cycle, for example.

With this sheet feeding mechanism, it is very important to vary the feeding amount of the sheet in response to the operation of the printer so as to accelerate its operation.

To vary the sheet feeding amount in a simple manner as described above, the stepping motor or servo-motor is widely used so as to drive the sheet feeding mechanism independently of other mechanisms in the printer. Such a motor enables the printer to speedily feed the sheet for blanklines as desired while no printing is carried out.

The printer is also required to be compact in size and light in weight as well as assuring a short operation time. There is a great demand for much smaller and lighter computer and office automation systems and their associated peripheral devices. Such a demand is likely to become intense as portable computers and word processors become more popular in the future.

The provision of an independent sheet feeding motor is, however, contradictory to the foregoing demand for smaller and lighter devices.

A variety of proposals have been made, in which a mechanism is sometimes used to operate a sheet feed motor and a printing head perpendicularly to the sheet feeding direction, or a ribbon feed motor is also operated for the sheet feeding. Thereby, the number of motors to be used can be decreased, which makes the printer compact in size, light in weight and less expensive.

However, since one motor is commonly used for a plurality of mechanisms, it becomes impossible to operate the motor so as to feed the sheet only when necessary. For example, it is not necessary to rotate the motor during the operation of the printing head since no sheet is fed. However, the motor should be rotated to operate the printing head which performs printing while it is being moved. Therefore, some measures should be taken when one motor is used for a plurality of mechanisms according to their functions. Generally, a sheet feed roller shaft is rotated via a power transmission mechanism including a clutch mechanism. To feed the sheet, the sheet feed roller shaft is driven by the motor via the clutch mechanism which is connected to the power transmission mechanism only when it is necessary to feed the sheet.

The sheet feeding mechanism is also required to rotate the sheet feed roller in response to the user's manual loading of a sheet into the printer. In such a case, it is impossible to rotate the sheet feed roller shaft manually when the cam mechanism is incorporated in the power transmission mechanism as described above. It is therefore very difficult for the user to load the sheet into the printer.

When one motor is commonly used for many devices as described above, it is however impossible to vary the rotation amount of the motor so as to feed the sheet to a desired extent as is done by an independent sheet feeding motor.

To meet the demand for a light and compact device, a printing head is sometimes so reduced in size that one line of letters is printed in two reciprocations of the printing head. Specifically, the upper half of the letters is printed by the printing head during a first reciprocation, and the lower half is printed during a second reciprocation thereof. In such a case, the sheet feeding mechanism has to feed the sheet not only for each normal line and blanklines but also for half-line for the lower half line printing.

SUMMARY OF THE INVENTION

It is therefore an object of this invention to provide a sheet feeder for a printer, in which one motor is used for a multiplicity of purposes. As well as for sheet feeding, it facilitates sheet loading and adjustment of the print start position, and can vary the amount of the sheet to be fed.

According to the invention, the sheet feeder includes a power transmission mechanism having a power switching mechanism, which permits manual operation of the sheet feed roller shaft by temporarily disconnecting the power of the motor from the roller shaft.

The power switching mechanism includes: a gear rotatively supported on the sheet feed roller shaft and axially movable thereon, having a clutch surface and receiving the power from the motor; a clutch wheel fixedly supported on the sheet feed roller shaft and having a surface to be in contact with the clutch surface of the gear; a pin fixed to a frame; and a control cam which is movable with the gear and has an engaging surface and a disengaging surface to come into contact with the pin so as to control the axial movement of the gear.

The sheet feed amount varying mechanism includes: a partial gear to be rotated so as to adjust the rotation of the sheet feed roller shaft; a first feed cam and a second feed cam having projections of different height so as to be selectively engaged with the partial gear, the first and second feed cams being coaxially supported with the partial gear; and a feed cam selecting mechanism.

The feed cam selecting mechanism is provided for selectively engaging either the first or second feed cam with the partial gear, and includes: a plurality of cotter pins which are movable in parallel to a shaft for supporting the first and second feed cams and lie between the first and second feed cams so as to be always engaged with one of the first and second feed cams and be selectively engaged with the other feed cam; a return ring fixedly supported on the shaft together with the first and second feed cams and having a thick portion and a thin portion on one side thereof so as to be in contact with sliding surfaces of the cotter pins; a selective lever which moves towards and away from the thin portion of the return ring, and an actuator for moving the selective lever to and from the thin portion of the return ring.

The power switching mechanism permits manual operation of the sheet roller shaft or automatic operation by the motor.

Only when the pin is in contact with the engaging surface of the control cam, does the clutch surface of the gear comes into contact with the clutch wheel so as to transmit the power of the motor to the sheet feed roller shaft. When the pin is in contact with the disengaging surface of the control cam, the gear is out of contact with the clutch wheel so as to disconnect the sheet feed roller shaft from the motor.

The cams having different height are selectively used so as to vary the feeding amount of the sheet.

In the cam selecting mechanism, when the selective lever is in contact with the thin portion of the return ring, the cotter pins have the sliding surface thereof contacted with the selective lever so that the first and second feed cams are kept uncoupled and said first feed cam moves the partial gear. When the selective lever comes away from the thin portion of the return ring, the sliding surfaces of the cotter pins come into contact with the thin portion of the return ring so that the first and second feed cams are coupled and the partial gear is turned by a projection of the second feed cam, thereby increasing the feeding amount of the sheet.

In the power switching mechanism, when the selective lever is in contact with the thin portion of the return ring, the cotter pins have the sliding surfaces thereof contacted with the selective lever so that the first and second feed cams are kept uncoupled and the first feed cam moves the partial gear, and when the selective lever comes away from the thin portion of the return ring, the sliding surfaces of the cotter pins come into contact with the thin portion of the return ring so that the first and second feed cams are coupled and the partial gear is turned by a projection of the second feed cam, thereby increasing the feeding amount of a sheet.

DETAILED DESCRIPTION OF PREFERRED EMBODIMENTS

The invention will be described with reference to an embodiment shown in the accompanying drawings.

Figure 1B:
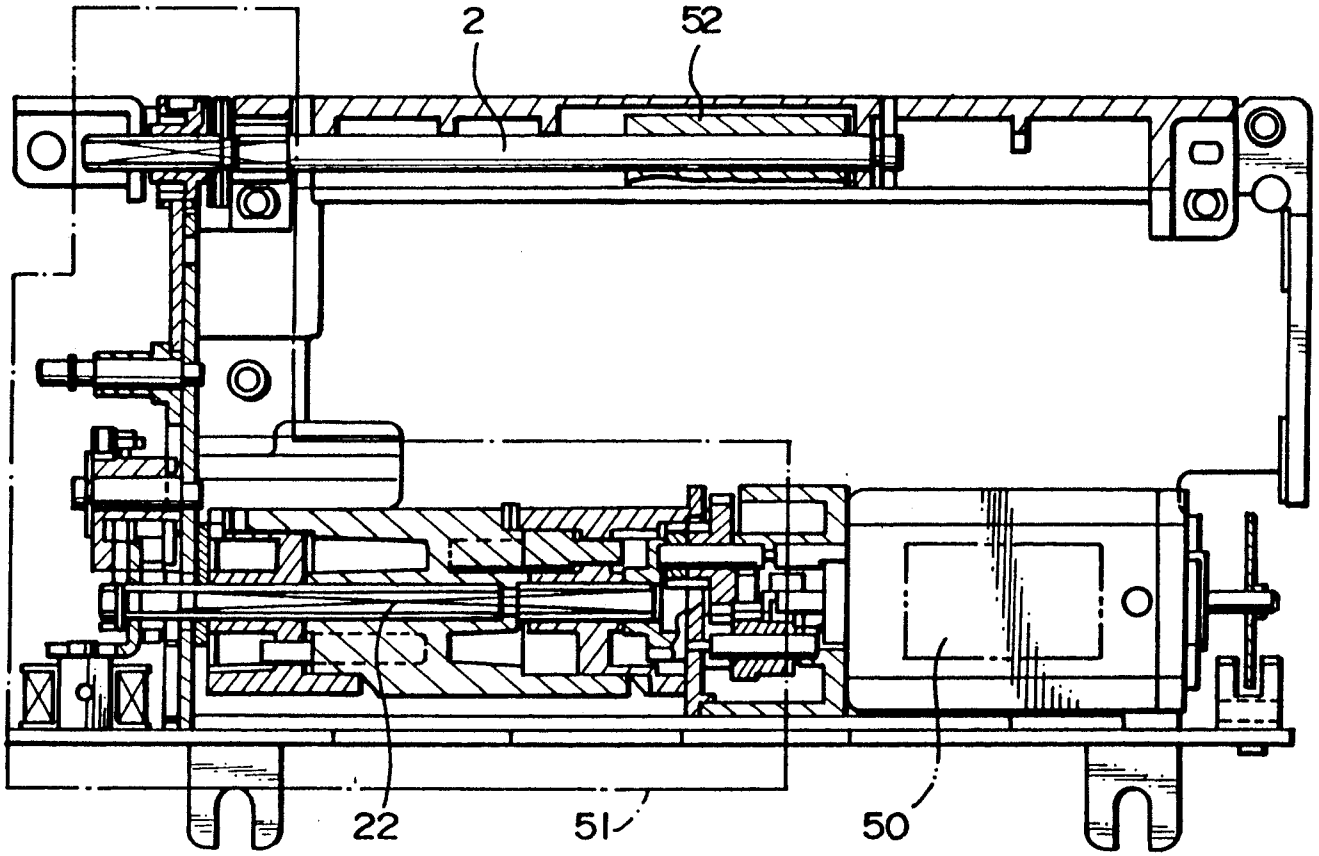
FIGS. 1A and 1B are a plan view and a cross-sectional view respectively of a sheet feeder according to one embodiment of this invention.
Figure 1A:
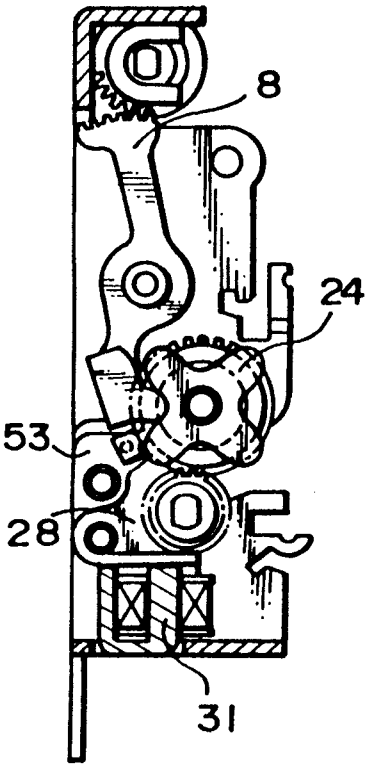
Figure 2A:
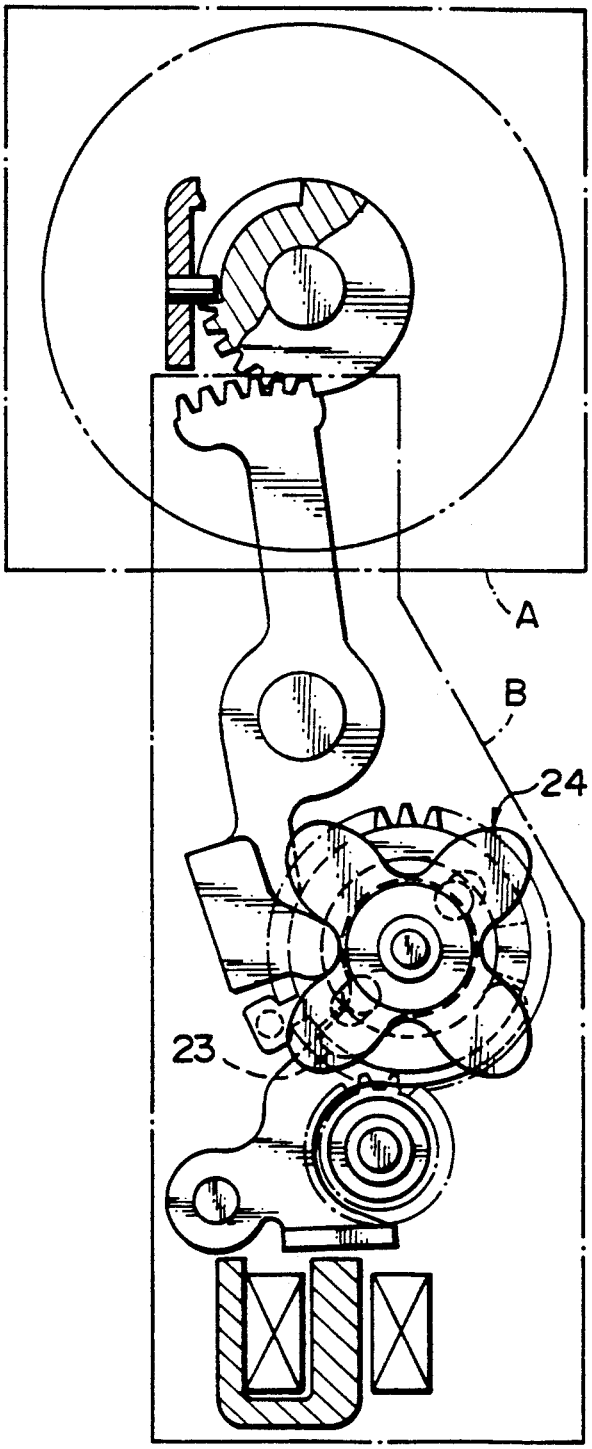
FIGS. 2A and 2B are a plan view and a cross-sectional view respectively of a power transmission mechanism for a sheet feeder according to one embodiment of this invention.
Figure 2B:
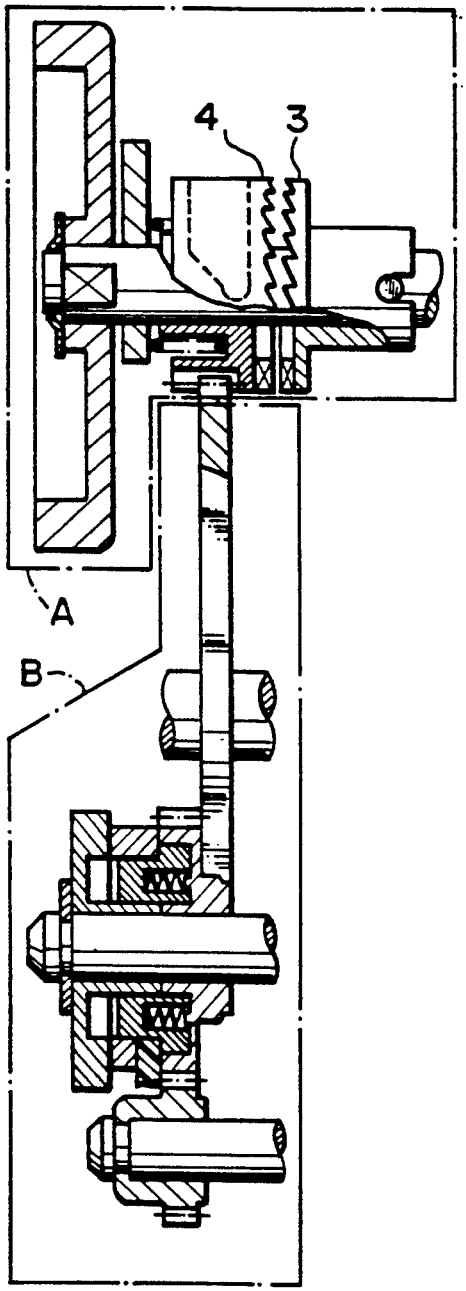
Figure 3:
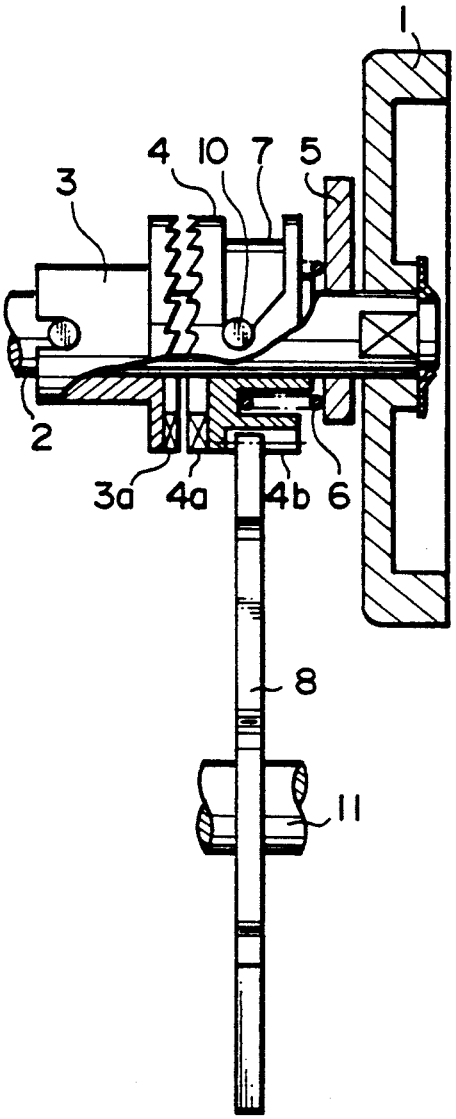
FIGS. 3 and 4 are a plan view and a cross-sectional view respectively of a power switching mechanism.

In FIGS. 1(A) and 1(B), a sheet feeder is shown, comprising a power transmission mechanism 51 for transmitting the power of a motor 50 to a sheet feed roller 52.

In FIGS. 1A, 1B, 2A, and 2B, the area A represents a power switching mechanism, and the area B represents a sheet feed amount varying mechanism.

A manual knob 1 is fixed to a sheet feed roller shaft 2, on which a sheet feed roller 52 is also fixedly supported. Therefore, the sheet feed roller is turned together with the feed roller shaft 2 and the knob 1. The knob 1 is manually operated to feed the sheet. A clutch wheel 3 is also disposed on the sheet feed roller shaft 2.

A gear 4 is also rotatably supported on the sheet feed roller shaft 2, and is axially movable thereon. The gear 4 lies near the clutch wheel 3. A spring 6 is disposed between the gear 4 and a frame 5 so as to urge the gear 4 toward the clutch wheel 3.

The gear 4 has a toothed peripheral edge on its one surface confronting the clutch wheel 3. The clutch wheel 3 also has a toothed portion on its one surface confronting the gear 4. These toothed portions serve as clutch surfaces 4*a* and 3*a*, respectively. The gear 4 has a grooved cam 7 on an outer surface thereof. The grooved cam 7 has an engaging portion 7*b* and disengaging portion 7*a*. A pin 10 is fixedly mounted on the frame 5, being engaged with the grooved cam 7. The pin 10 and the grooved cam 7 control to engage or disengage the gear 4 with or from the clutch wheel 3. On its outer surface, the gear 4 also has a toothed portion 4*b*, which is engaged with a toothed portion 8*b* of a partial gear 8.

The partial gear 8 is rotatably supported on a support shaft 11, and has a push member 8*a* on one end. The push member 8*a* is in contact with a feed cam 9 which is rotated by a motor 50. The push member 8*a* is pushed by a projection 9*a* of the feed cam 9 so as to turn the partial gear 8.

Figure 4:
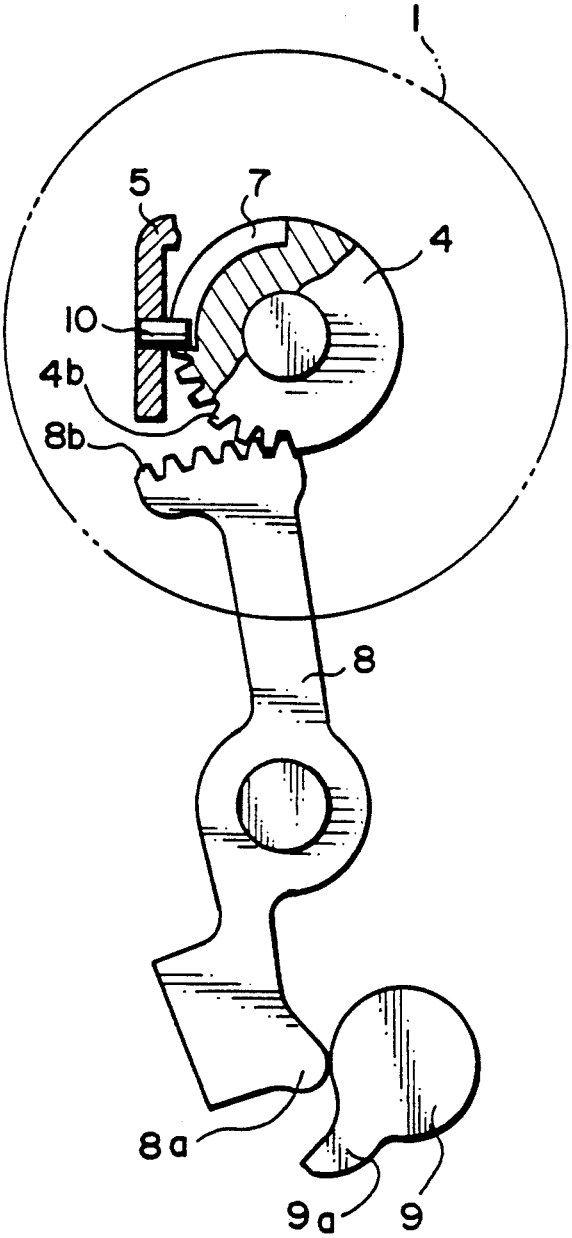
Figure 5:
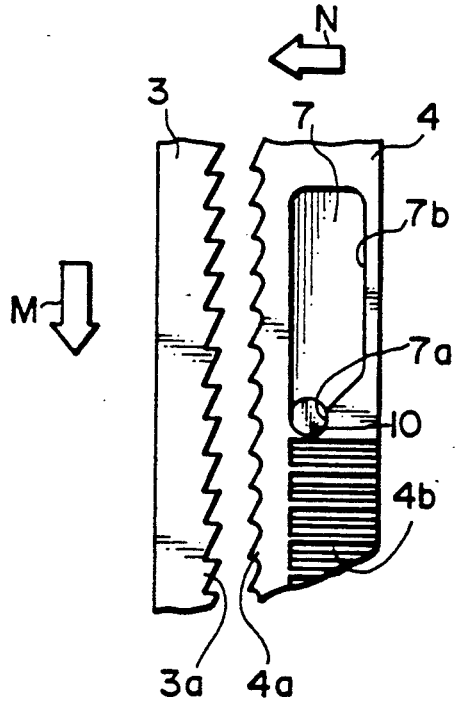
FIGS. 5 and 6 show the operation of the power switching mechanism.
Figure 6:
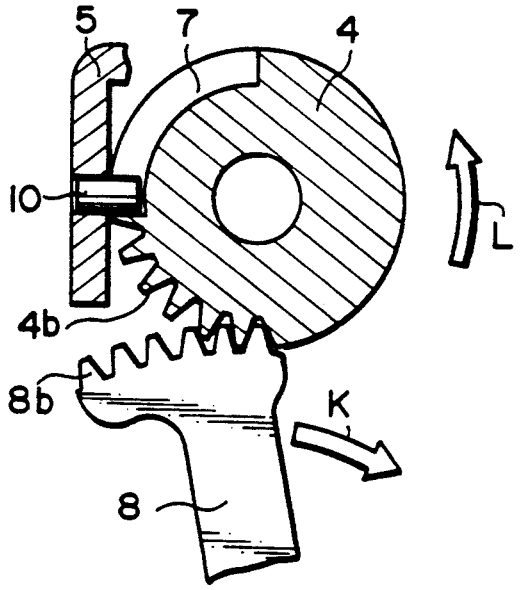
Figure 7:
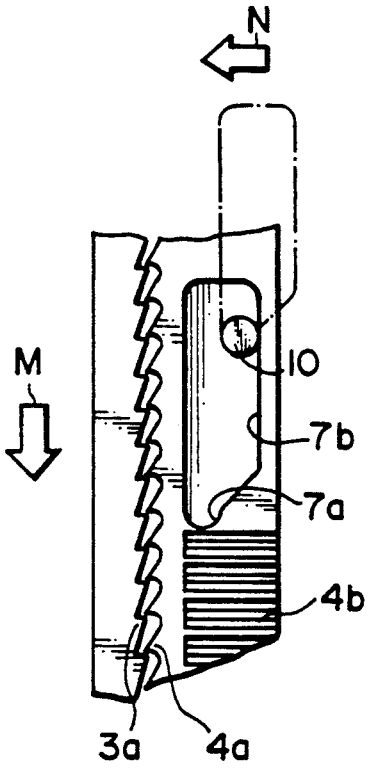
FIGS. 7 and 8 also show the operation of the power switching mechanism.

The following describes how the sheet feed roller shaft is rotated by the motor with reference to FIGS. 3 to 7. Specifically, FIGS. 5 to 7 show how the power switching mechanism works. FIGS. 5 and 7 are expanded view of the gear 4 and clutch wheel 3.

As shown in FIG. 4, the feed cam 9 is rotated by the power from the motor 50 so as to push the push member 8*a* of the partial gear 8 by the projection 9*a*. Thereby, the partial gear 8 is swung so that the gear 4 is turned by the toothed portion 8*b*.

Figure 8:
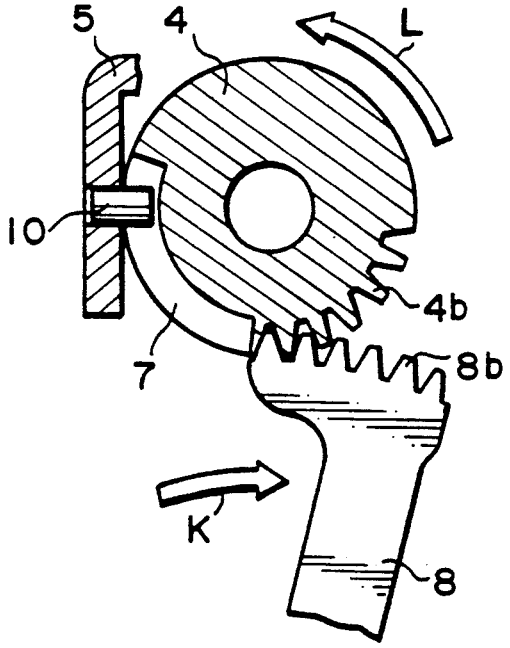

When the partial gear 8 is swung in the direction shown by an arrow K in FIGS. 5 and 6, the gear 4 begins to turn in the direction shown by another arrow L. In FIG. 5, the rotating direction of the gear 4 is shown by an arrow M. Therefore, the grooved cam 7 also moves in the direction M, so that the pin 10 leaves the disengaging portion 7*a* of the grooved cam 7. The gear 4 is urged in the direction N by the spring 6 as described above. When the pin 10 moves away from the disengaging portion 7*a*, the gear 4 is moved in the direction N by the bias of the spring 6. The clutch surface 4*a* of the gear 4 comes into contact with the clutch surface 3*a* of the clutch wheel 3, thereby transmitting the rotating power of the gear 4 to the clutch wheel 3. FIGS. 7 and 8 show this condition. The grooved cam 7 moves from a position shown by a chain line to that shown by a solid line. Under this condition, the clutch surfaces 4*a* and 3*a* are engaged with each other. The power of the motor rotates the roller shaft 2 on which the clutch wheel 3 is fixedly supported, so that the sheet is fed.

The partial gear 8 moves in the direction K, and the gear 4 turns in the direction L as described above. Then, the partial gear 8 and the gear 4 turn in the directions opposite to the directions K and L, respectively, thereby resuming their initial states. The clutch surfaces 4*a*, 3*a* of the gear 4 and the clutch wheel 3 serve as a one-way clutch, so that no reverse power is transmitted to the roller shaft 2.

The power of the motor is transmitted in only one direction, i.e. in the direction L, so as to feed the sheet.

Only when the feed cam 9 moves the partial gear 8, is the power of the motor transmitted to the feed roller shaft 2, thereby feeding the sheet intermittently. Thus, the motor for the printing head can be also used for the sheet feeding mechanism.

Since the knob 1 and the sheet feed roller are fixedly supported on the sheet feed roller shaft 2, the sheet can be fed by manually operating the knob 1. The knob 1 is turned forwardly or backwardly so as to feed the sheet accordingly. This feature is an advantage when loading the sheet into the printer or adjusting the print start position on the sheet.

The motor does not rotate when the knob 1 is operated to feed the sheet. Therefore, the gear 4 and the clutch wheel 3 are uncoupled so that the sheet feeding can be carried out without interference from the power transmission mechanism.

As described so far, the knob 1 is manually operated when loading the sheet or when adjusting the print start position. Once the printing is started, the sheet will be fed by the motor via the power transmission mechanism.

This embodiment is characterized in that the gear 4 has both the grooved cam 7 and the toothed portion 4*b* formed in series on the circumference thereof. In other words, the axial length of the gear 4 can be shortened compared with a case where the grooved cam 7 and the tooth portion 4*b* axially exist at different positions in the axial direction of the gear 4. Therefore, the printer can be made compact.

Further, the embodiment features that the partial gear 8 is used to transmit the power of the motor to the sheet feed roller shaft 2. This is effective to reduce the number of parts compared with a case where the power is transmitted via a gear train. Complete gears have to be used to transmit the power of the motor by the rotating motion. According to this invention, the power of the motor is transmitted by the rocking motion of the partial gear. This is also effective to the arrangement in which the grooved cam 7 and the toothed portion 4*b* are formed in series on the circumference of the gear 4.

The knob 1 is fixedly supported on the sheet feed roller shaft 2. The roller shaft 2 may be rotated via a gear train. In such a case, the knob 1 may be disposed on a shaft which is different from the sheet feed roller shaft 2, thereby enabling the sheet feeder to be designed more freely.

Figure 9:
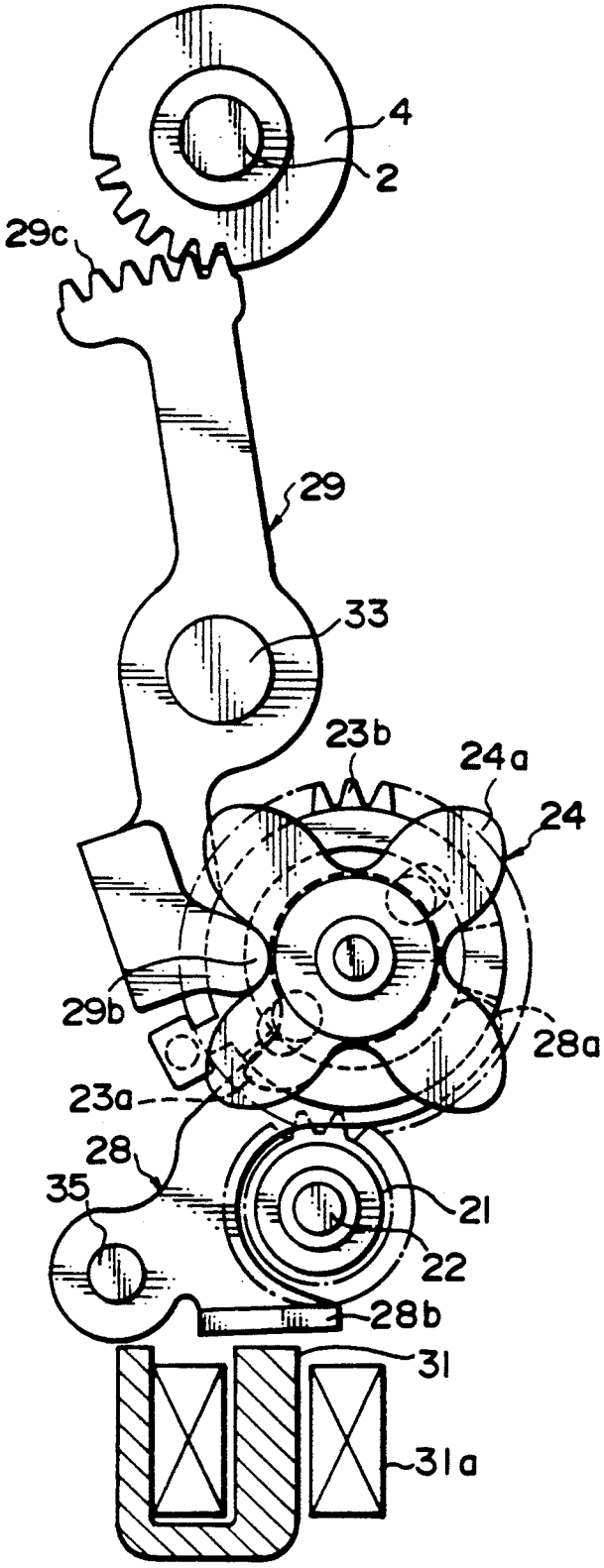
FIGS. 9 and 10 show the overall configuration of a sheet feed amount varying mechanism according to the invention.
Figure 10:
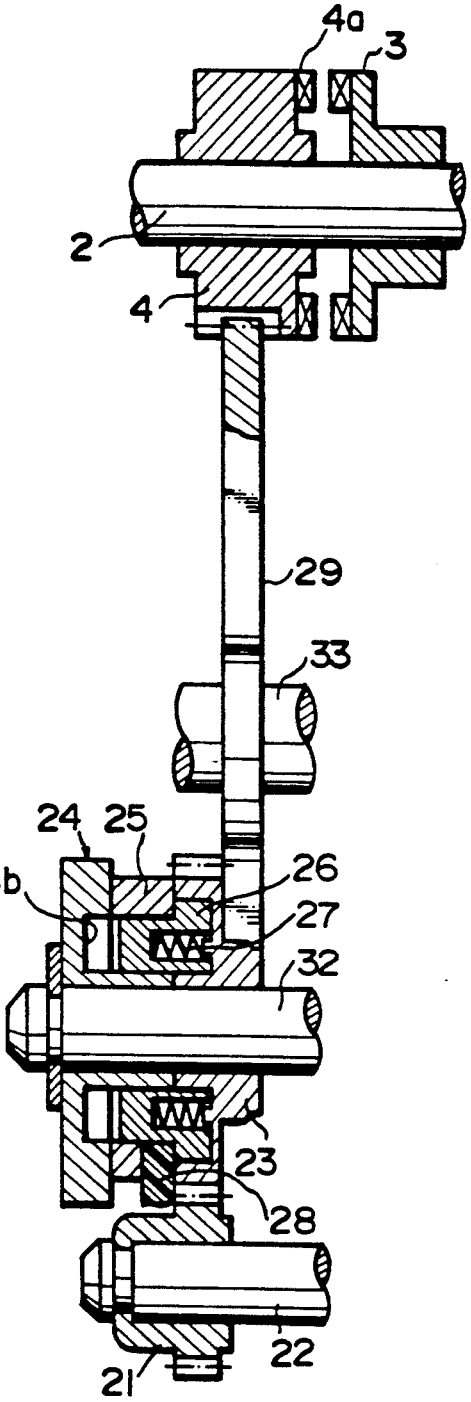
Figure 11:
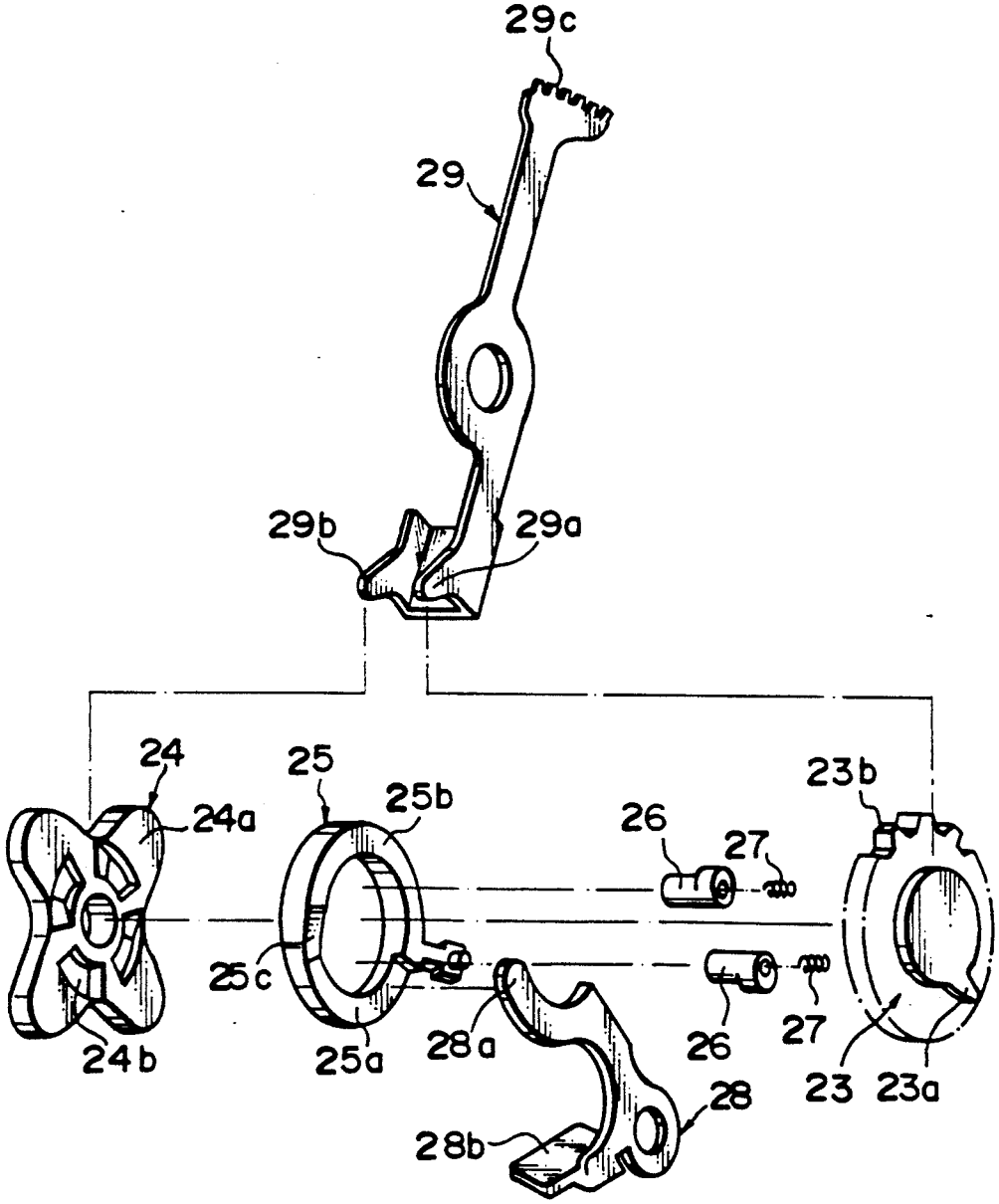
FIG. 11 is an exploded perspective view of the sheet feed amount varying mechanism.

FIG. 9 shows a sheet feed amount varying mechanism. FIG. 10 is a cross-sectional view of the mechanism of FIG. 9. FIG. 11 is an exploded perspective view of the mechanism of FIG. 9.

A driving gear 21 is rotated by the motor 50 via a driving shaft 22. This motor is rotating at a constant speed, and is also used to reciprocate the printing head. The driving gear 21 is engaged with a feed gear 23*b* so as to transmit power thereto. The feed gear 23*b* is rotatably disposed on a first support shaft 32 which is parallel to the driving shaft 22. The driving gear 21 and the feed gear 23*b* have a gear ratio by which the feed gear 23*b* rotates once per reciprocation of the printing head. A first feed cam 23 has a projection 23*a* on its circumference, being disposed on the support shaft 32 with the feed gear 23*b*, and being coupled to the feed gear 23*b*. Therefore, the first feed cam 23 and the feed gear 23*b* rotate integrally once per reciprocation of the printing head.

A second feed cam 24 is also rotatably disposed on the first support shaft 32. The second feed cam 24 has, on its circumference, four projections 24*a*-1, 24*a*-2, 24*a*-3, 24*a*-4, and valleys 24*b*-1, 24*b*-2, 24*b*-3, 24*b*-4 between the foregoing projections. The projections 24*a*-1 to 24*a*-4 are higher than the projection 23*a* of the first feed cam 23. Unless otherwise specified, the projections and valleys of the second feed cam 24 are called "the projections 24*a*" and "the valleys 24*b*" hereinafter. The second feed cam 24 is selectively coupled to the first feed cam 23 by a selective mechanism so as to receive the power from the driving shaft 21.

The selective mechanism includes cotter pins 26-1, 26-2, a return ring 25, a selective lever 28, and an actuator 31. The cotter pins 26-1, 26-2 are called "cotter pins 26" unless otherwise specified.

Two cotter pins 26 are disposed in parallel to the support shaft 32 at a position which is to the side of the first feed cam 23 facing the second feed cam 24. The cotter pins 26 are rotated together with the first feed cam 23, being biased by a spring 27 toward the second feed cam 24. Each cotter pin 26 has a small diameter portion, a large diameter portion, and an intermediate portion between the small and large diameter portions. The intermediate portion of the cotter pin 26 is urged to be engaged with a side surface of the return ring 25 or selective lever 28 by the spring 27. The intermediate portion serves as a sliding surface 26*a*.

The return ring 25 is immovably disposed between the first and second feed cams 23 and 24. Specifically, one peripheral edge of the return ring 25 is divided into three portions, i.e. thin, sloped and thick portions 25*a*, 25*b*, 25*c*, which come into contact with the sliding surfaces 26*a* of the cotter pins 26. In the return ring 25, the sloped portion 25*c* is positioned between the thin and thick portions 25*a*, 25*b*. When the sliding surface 26*a* of the cotter pin 26 is in contact with the thin portion 25*a* of the return ring 25, the cotter pin 26 projects toward the second feed cam 24 to reach the valley 24*b*. Under this condition, the first and second feed cams 23, 24 are coupled so that the power is transmitted to the second feed cam 24 via the driving shaft 21. On the contrary, when the sliding surface 26*a* is in contact with the thick portion 25*b* of the return ring 25, the cotter pin 26 is pushed back toward the first feed cam 23 against the spring 27. The operation of the cotter pin 26 is controlled by the selective lever 28.

The selective lever 28 includes an arm 28*a* and a crosspiece 28*b*, and is rotatably disposed on a lever support shaft 35 which is parallel to the first support shaft 32. When the selective lever 28 is rotated around the lever support shaft 35, the arm 28*a* moves into contact with or out of contact from the thin portion 25*a* of the return ring 25. When the arm 28*a* is in contact with the thin portion 25*a* of the return ring 25, the arm 28*a* lies between the return ring 25 and the sliding surface 26*a* of the cotter pin 26, thereby preventing the sliding surface 26*a* from being in contact with the thin portion 25*a* of the return ring 25. Therefore, the cotter pin 26 does not stick out toward the second feed cam 24, keeping the first and second feed cams 23, 24 uncoupled.

An actuator 31 controls the forward and backward movement of the arm 28*a* of the selective lever 28. An electromagnetic solenoid is used as the actuator 31 in this embodiment. When it has a current applied, a solenoid 31*a* attracts the crosspiece 28*b* as an armature, thereby rotating the selective lever 28 on the lever support shaft 35. Then, the arm 28*a* moves away from the thin portion 25*a* of the return ring 25. When no current is applied to the solenoid 31*a*, the arm 28*a* is advanced by a spring (not shown) toward the thin portion 25*a* of the return ring 25.

Thus, the power is transmitted to the first feed cam 23 from the driving shaft 21, and is then selectively transmitted to the second feed cam 24 by the selective mechanism.

A partial gear 29 is rotatably supported on a second support shaft 33 which is parallel to the first support shaft 32. The partial gear 29 includes first and second push members 29*a*, 29*b* on its one end, and a toothed portion 29*c* on the other end. The push members 29*a*, 29*b* are associated with the first and second feed cams 23, 24, respectively. The partial gear 29 is swung according to the height of the first and second feed cams 23, 24. Specifically, when the second feed cam 24 is stationary, the first feed cam 23 is engaged with the first push member 29*a*. Otherwise, when it is rotating, the second feed cam 24 is engaged with the second push member 29*b* because the second feed cam 24 projects higher than the first feed cam 23. A cam selecting mechanism will be described later.

When the partial gear 29 is moved, the toothed portion 29*c* turns its mating gear 4. The gear 4 is rotatably supported on a sheet feed roller 2 which is in parallel to the first and second support shafts. The gear 4 includes on its one side the clutch surface 4*a*, which is engaged with the clutch wheel 3 fixedly mounted on the sheet feed roller 2 so as to serve as the one-way clutch. The gear 4 is rotatable clockwise and counterclockwise in response to the movement of the partial gear 29. The foregoing one-way clutch however always makes the sheet feed roller shaft 2 rotate unidirectionally. The sheet feed roller 52 is fixedly disposed on the sheet feed shaft 2 so as to feed the sheet to a predetermined extent according to the rotation of the sheet feed roller shaft 2.

Operation of the first and second feed cams 23, 24 as the selective mechanism will be described with reference to FIGS. 12 to 14.

The following describes the sheet feeding by the first feed cam 23.

Figure 12:
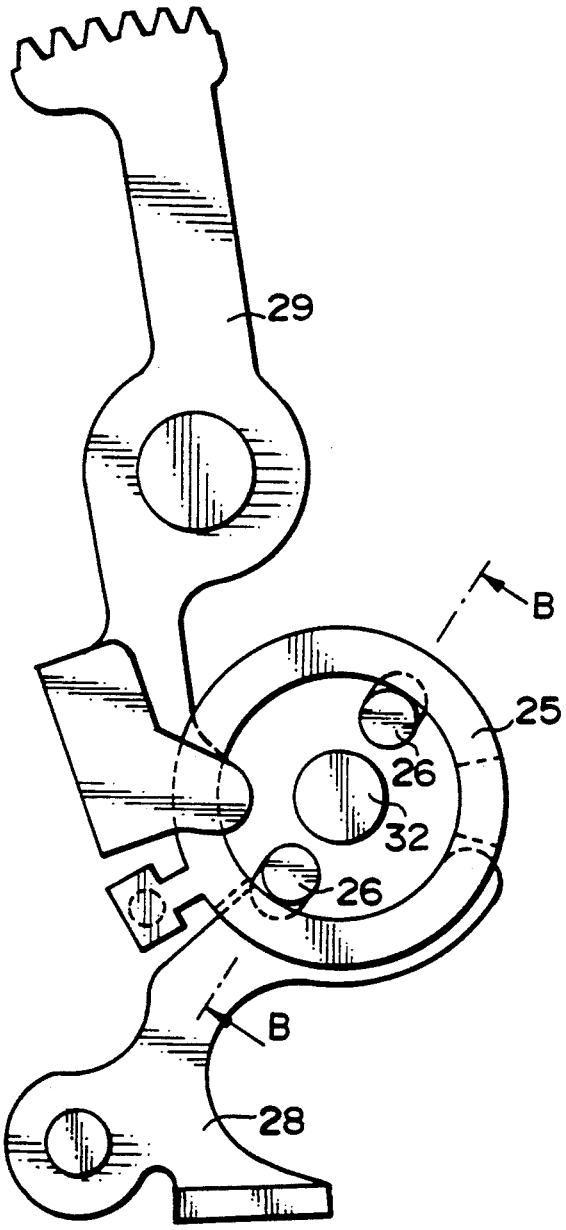
FIGS. 12 and 13 show a manner in which a cotter pin operates when a selective lever reaches a thin portion of a return ring.
Figure 13:
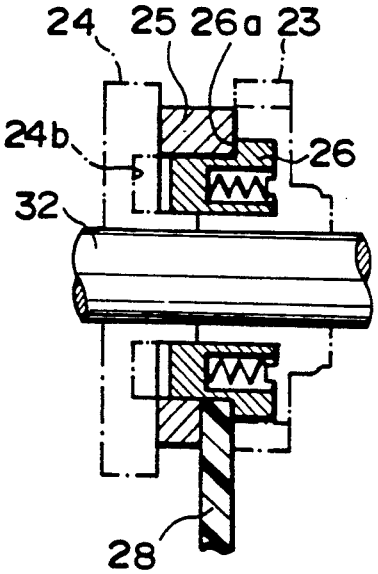

FIGS. 12 and 13 show the manner in which the selective lever is in contact with the thin portion 25*a* of the return ring 25. As shown in FIGS. 12 and 13, the selective lever 28 has a counterclockwise torque applied by the spring (not shown). The return ring 25 is fixed to the printer frame 53 (in FIG. 1(A)). Under this condition, the arm 28*a* of the selective lever 28 lies between the thin portion 25*a* of the return ring 25 and the sliding surface 26*a* of the cotter pin 26, so that the cotter pin 26 is pushed back toward the first feed cam 28 against the spring 27. Accordingly, the cotter pin 26 cannot reach the valley 24*b* of the second feed cam 24. On the contrary, when the sliding surface 26*a* of the cotter pin 26 is in contact with the thick portion 25*b* of the return ring 25, the cotter pin 26 is also pushed back toward the first feed cam 23, and does not reach the valley 24*b* of the second feed cam 24. Therefore, the first and second feed cams 23, 24 remain uncoupled. The second feed cam 24 remains stationary.

Figure 14:
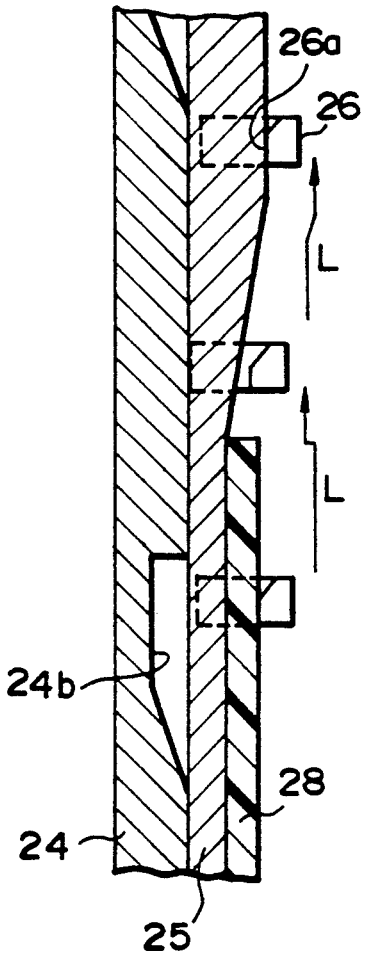
FIG. 14 shows the operation of the cotter pin and a second feed cam when the selective lever is in contact with the thin portion of the return ring.

FIG. 14 is a cross-sectional view schematically showing the state where the cotter pin 26 itself rotates by the first feed cam 23 (not shown) but is not engaged with the valley 24*b* of the second feed cam 24. As shown in FIG. 14, the cotter pin 26 slides in the direction shown by arrows L. The sliding surface 26*a* of the cotter pin 26 is prevented from reaching the valley 24*b* of the second feed cam 24 by the return ring 25 and the arm 28*a* of the selective lever 28. Therefore, the first and second feed cams 23, 24 remain uncoupled.

The sheet is fed as follows by the second feed cam 24.

Figure 15:
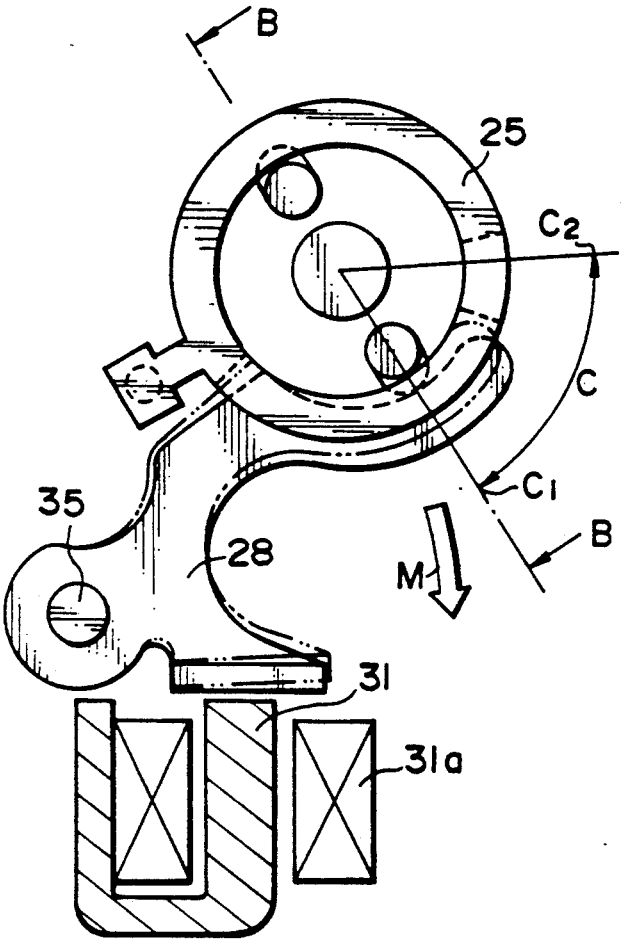
FIGS. 15 and 16 show the operation of the cotter pin when the selective lever moves away from the thin portion of the return ring.
Figure 16:
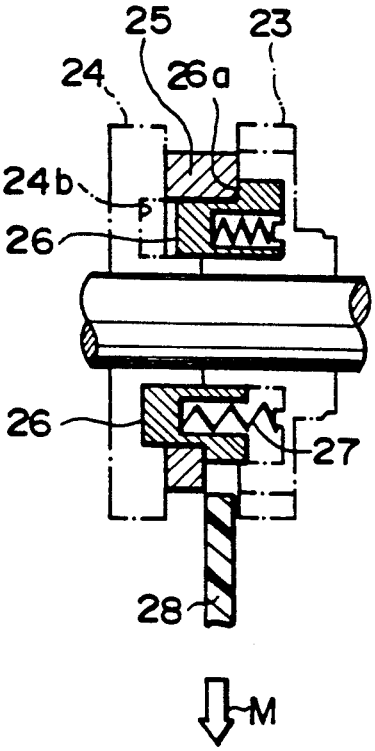

FIGS. 15 and 16 show that the arm 28*a* of the selective lever 28 is kept away from the thin portion 25*a* of the return ring 25. When the solenoid 31*a* of the actuator 11 has the current applied, the actuator 31 magnetically attracts the crosspiece 28*b* of the selective lever 28, which is rotated clockwise on the lever support shaft 35 (in the direction shown by an arrow M), reaching a solid line position from a position shown by a chain line in FIGS. 15 and 16. When the arm 28*a* of the selective lever 28 comes away from the thin portion 25*a*, the return ring 25 has a portion where the arm 28*a* does not lie between the sliding surface 26a of the cotter pin 26 and the thin portion 25a of the return ring 25. Following the rotating first feed cam 23, the cotter pin 26 reaches the thin portion 25a of the return ring 25, thereby remaining disengaged from the arm 28a. This portion corresponds to the start point $C_1$ in the section C shown in FIG. 15. Since there is no obstacle under this condition, the cotter pin 26 sticks out toward the second feed cam 24, reaching the valley 24b of the second feed cam 24. In the section C between $C_1$ and $C_2$, the cotter pin 26 lies in the valley 24b of the second feed cam 24. This condition is shown in the lower half of FIG. 16. Therefore, the second feed cam 24 is coupled with the first feed cam 23 to be rotatable integrally.

The first and second feed cams 23, 24 will be uncoupled as described below.

Figure 17:
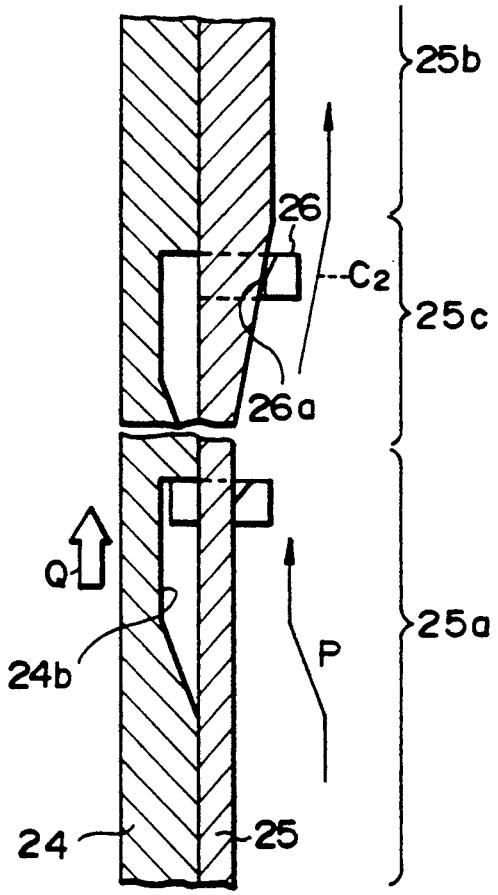
FIG. 17 shows the operation of the cotter pin and the second feed cam when the selective lever moves away from the thin portion of the return ring.

FIG. 17 schematically shows the rotation of the second feed cam 24. The cotter pin 26 is turned with the first feed cam 23 as shown by an arrow P. At the section C, the cotter pin 26 is engaged with the second feed cam 24, rotating the second feed cam 24 in the direction shown by the arrow Q.

The cotter pin 26 keeps on moving until it reaches the sloped portion 25c of the return ring 25. Then, the cotter pin 26 is gradually pushed back toward the first feed cam 23 by the sloped portion 25c of the return ring 25. At the section $C_2$, the cotter pin 26 moves from the valley 24b of the second feed cam 24, thereby uncoupling the first and second feed cams 23, 24.

Operation of the selective lever 28 is controlled so as to selectively let the cotter pin 26 reach or leave the second feed cam 24, thereby respectively coupling the first and second feed cams 23, 24, or keeping these cams 23, 24 uncoupled.

Figure 18:
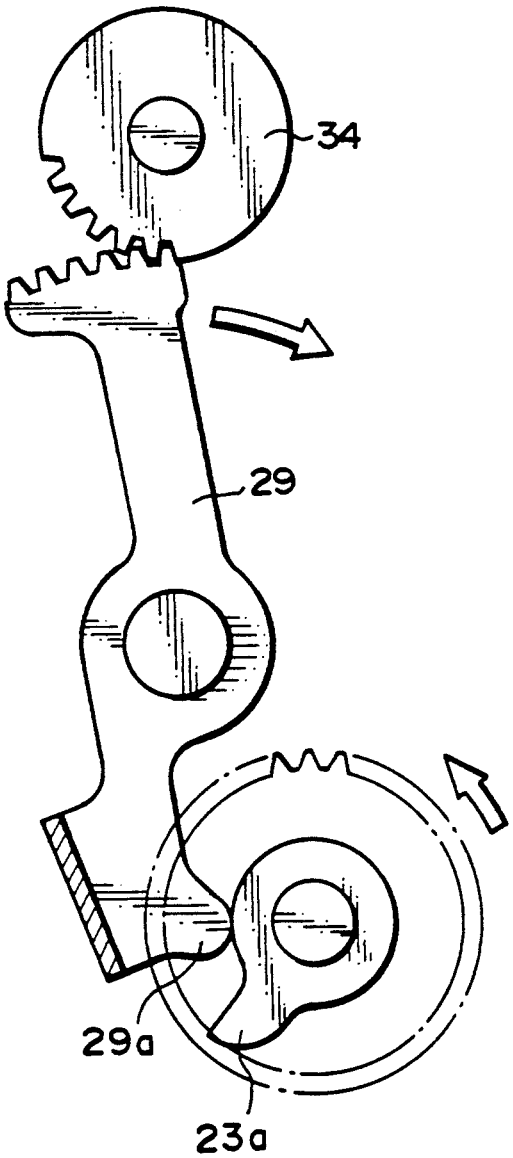
FIG. 18 shows the operation of a first feed cam.
Figure 19:
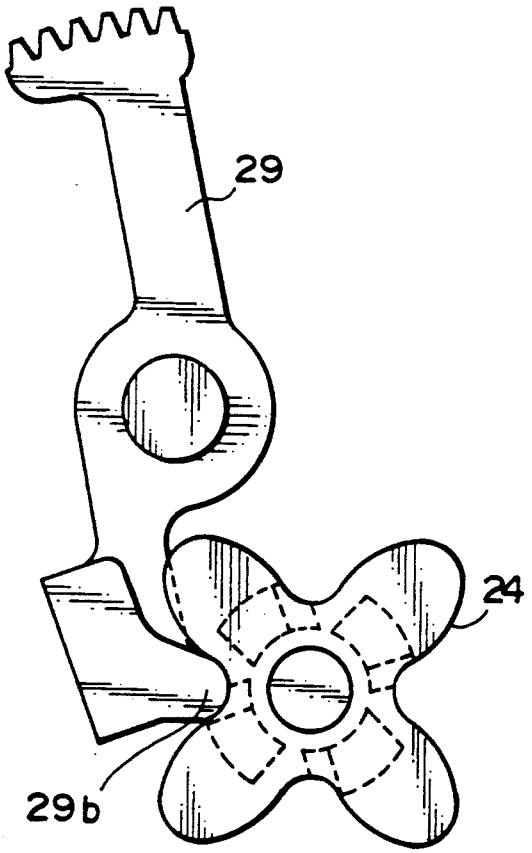
FIG. 19 shows the relation between the second feed cam and a partial gear when the second feed cam is stationary.

Operation of the first feed cam 23 will be described with reference to FIGS. 18 and 19.

The partial gear 29 always has the counterclockwise torque applied by the spring (not shown) as described above. When the first and second feed cams 23, 24 are kept uncoupled by the selective mechanism, the first push member 29a of the partial gear 29 is in contact with the first feed cam 23. As it rotates, the first feed cam 23 has its projection 23a push the first push member 29a. Then, the first feed cam 23 is returned to its initial position by the spring (not shown) after the projection 23a passes over the push member 29a. Thus, the partial gear 29 swings to the predetermined extent according to the height of the projection 23a of the first feed cam 23.

Under this condition, the second feed cam 24 remains uncoupled from the first feed cam 23, so that the second feed cam 24 does not rotate since no power is supplied thereto. When the second feed cam 24 remains stationary, the second push member 29b associated with the second feed cam 24 stays in the valley 24b as shown in FIG. 19. This is because the partial gear 29 always has the counterclockwise torque applied as described above. The partial gear 29 is made to swing by the first feed cam 23 while the first feed cam 23 is uncoupled from the second feed cam 24.

Figure 20:
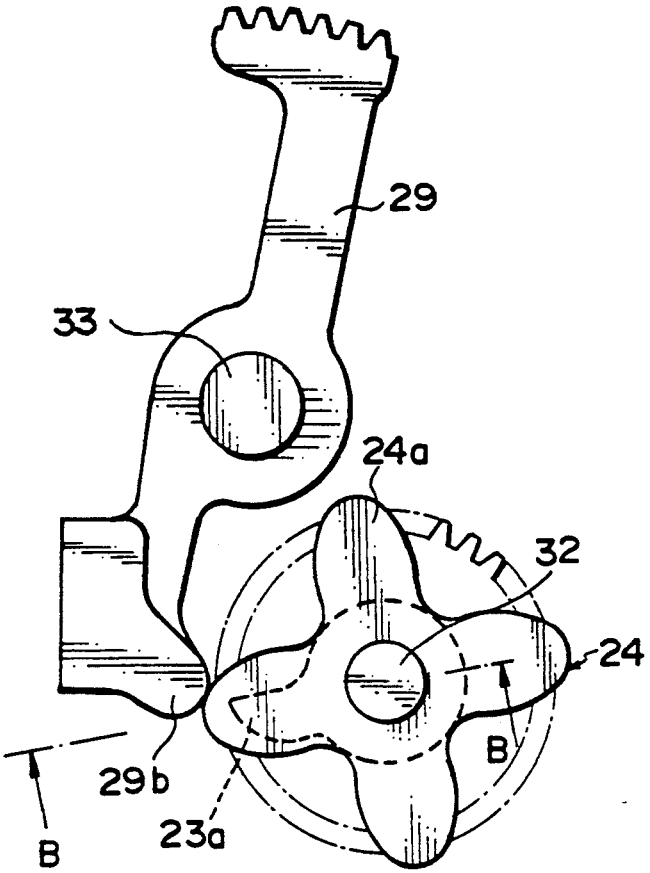
FIGS. 20 and 21 show the operation of the second feed cam.
Figure 21:
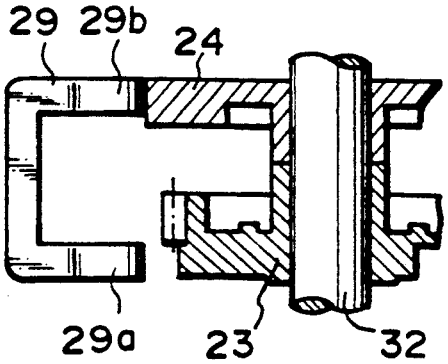

FIGS. 20 and 21 show the manner in which the second feed cam 24 rotates integrally with the first feed cam 23. Since the projection 24a of the second feed cam 24 is higher than the projection 23a of the first feed cam 23, the first push member 29a of the partial gear 29 leaves from the first feed cam 23. Then the second push member 29b is pushed by the second feed cam 24. FIG. 20 shows that the projection 23a of the first feed cam 23 is at a position to confront the first push member 29a. Needless to say, when the first feed cam 23 confronts the first push member 29a at the positions other than the projection 23a, the second push member 29b is pushed by the second feed cam 24. When pushed, the partial gear 29 swings on the second support shaft 33. Under this condition, since the projection 24a of the second feed cam 24 is higher than the projection 24a of the first feed cam 23, the partial gear 29 swings accordingly. The partial gear 29 is returned to its initial position (as shown in FIG. 19) by the non-illustrated spring after the projection 24a passes over the second push member 29b.

To receive the power via the selective mechanism, the second feed cam 24 makes the partial gear 29 swing. Although it is always in rotation, the first feed cam 23 is not directly concerned with the swing of the partial gear 29 under this condition. In other words, since the projection 24a of the second feed cam 24 is higher than the projection 23a of the first feed cam 23, the second push member 29b of the partial gear 29 is pushed by the projection 24a, keeping the first push member 29a uncoupled from the first feed cam 23. Therefore, the first feed cam 23 or second feed cam 24 is selected depending upon whether or not the second feed cam 24 is rotated.

Operation of the printer employing the foregoing sheet feeder will be described hereinafter.

Figure 22:
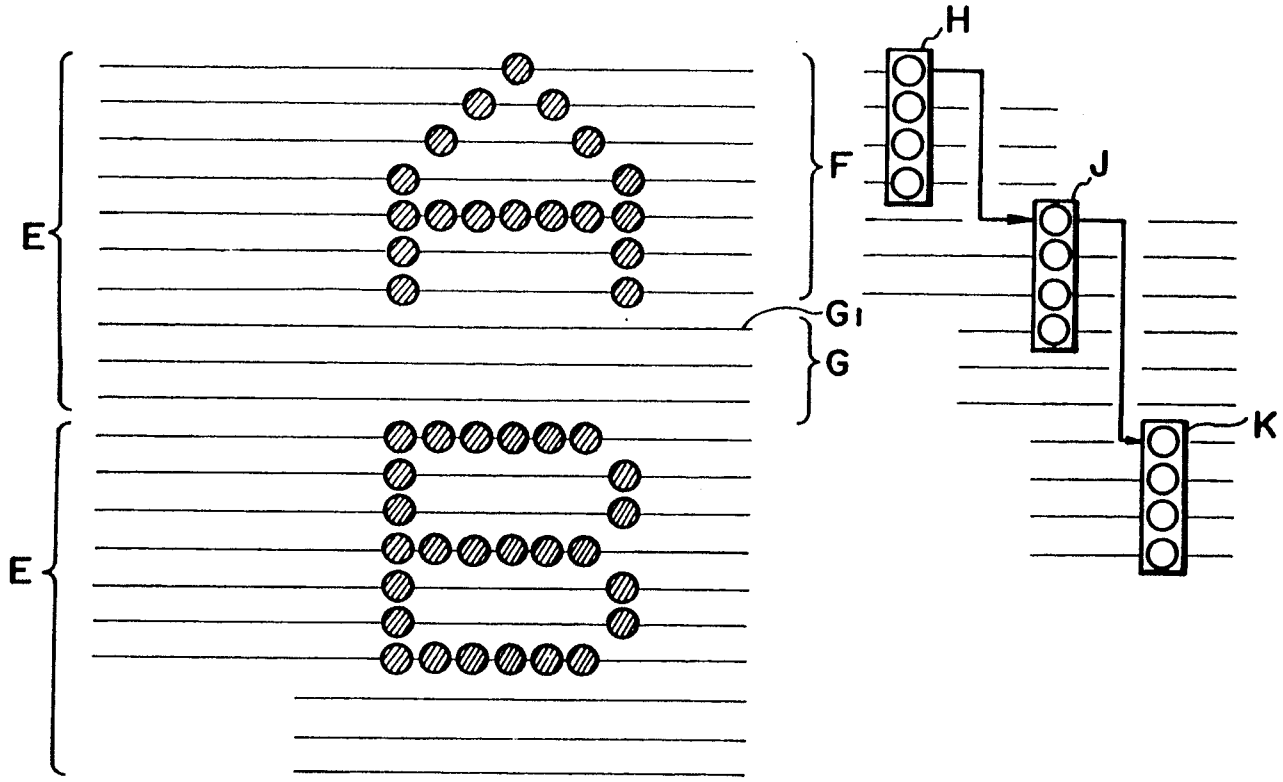
FIG. 22 shows the relation between sheet feeding and dot-lines during printing.

As shown in FIG. 22, the printer is a dot matrix printer in which one line (portion E) includes ten dot-lines. Seven out of ten dot-lines (portion F) are actually used for printing, while three dot-lines are blanks (portion G).

In this embodiment, the first feed cam 23 is used to feed the sheet for the four dot-lines, and the second feed cam 4 is for the remaining six dot-lines. Specifically, the projections 23a and 24a of the feed cams 23 and 24 are designed so as to feed the sheet for the four dot-lines and six dot-lines, respectively.

The printing head prints four dot-lines per reciprocation, and completes printing the whole of one line by two reciprocation thereof. As shown in FIG. 22, firstly the printing head performs printing at the position H during the first reciprocation. Then, the sheet is fed by four dot-lines, where the next printing is performed at the position J. The two reciprocations of the printing head complete the printing on the eight dot-lines. However, the printing is actually executed on the seven dot-lines, and the eighth dot-line ($G_1$) is left as a blank. Thus, the printing head completes printing one line in its two reciprocations.

To print another line, the sheet is fed for six dot-lines, so that the printing head starts printing the next line at the position K. During the normal printing, the sheet is alternately fed by 4 dot-lines, 6 dot-lines, 4 dot-lines, 6 dot-lines, and so on. The first feed cam 23 moves the partial gear 29 to feed the sheet by 4 dot-lines, while the second feed cam 24 moves the partial gear 29 to feed the sheet by 6 dot-lines. The foregoing selective mechanism selectively operates the first or second feed cam 23 or 24.

It is also conceivable that five dot-line printing is performed twice when one line is composed of ten dot-lines. In such a case, it is not necessary to vary the sheet feeding amount. However, the three dot-lines are not printed in the second reciprocation, which means that the printer cannot be operated effectively. In this case, the printing head inevitably becomes large, which is contradictory to the demand for more effective, smaller and lighter printers. Therefore, the mechanism of this embodiment is very advantageous to alternately feed the sheet for four dot-lines and for six dot-lines.

In addition to the sheet feeding for the normal printing process, the printer feeds the sheet for blanklines at the end of the printing and when there is nothing to be printed. If the printer feeds the sheet for the blanklines by the usual four or six dot-line feeding, it will take a lot of time for such blank space feeding. The printing period can be shortened as a whole if the printer can feed a large amount of the sheet during one reciprocation period of the printing head.

According to the invention, the printer is designed to feed 12 or 10 dot-lines per rotation of the first feed cam 23 as described hereinafter.

Figure 23A:
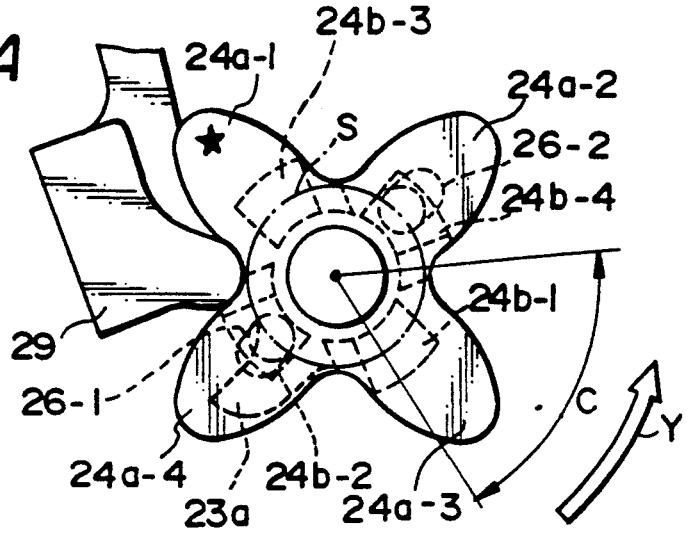
FIGS. 23A to 23C show the operation for feeding an increased amount of a sheet.
Figure 23B:
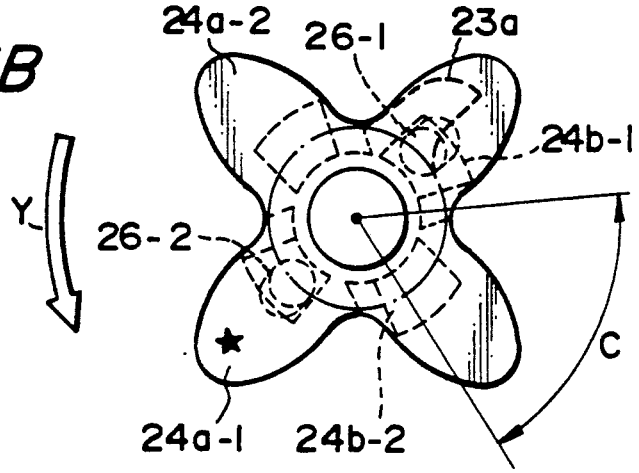
Figure 23C:
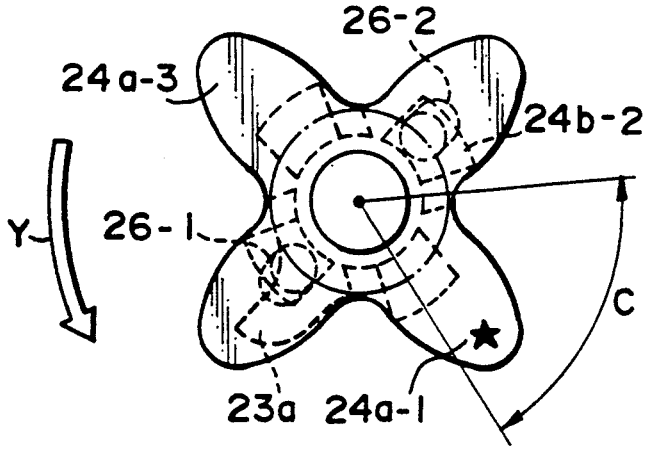

The second feed cam 24 has four projections and valleys 24*a*, 24*b* as described above. The four projections are designated 24*a*-1, 24*a*-2, 24*a*-3, 24*a*-4, and the valleys are 24*b*-1, 24*b*-2, 24*b*-3, 24*b*-4. The cotter pins are designated 26-1, 26-2, respectively. These members are shown in FIG. 23A. In FIGS. 23A to 23C, the star mark represents the projection 24*a*-1 so as to show the rotation of the second feed cam 24 clearly.

The cotter pins 26-1, 26-2 are symmetrically positioned on their rotary shaft and move around an imaginary circle S. The cotter pins 26 lie in the valleys 24*b* of the second feed cam 24 in the section C. In other words, the second feed cam 24 is coupled to the first feed cam 23 to rotate integrally only while the cotter pins lie in the section C.

The printer feeds the sheet for 12 dot-lines or 10 dot-lines as follows.

For the 12 dot-line feeding, the cotter pin 26-1 turns counterclockwise (in the direction Y in FIG. 23A) with the first feed cam 23 from the position shown in FIG. 23A, reaching the section C. Then, the selective lever 28 is turned so that the cotter pin 26-1 moves to the valley 24*b*-1 of the second feed cam 24, thereby rotating the second feed cam 24. The projection 24*a*-1 makes the partial gear 29 swing so as to feed the sheet. When it is moves further to pass over the section C, the cotter pin 26-1 is pushed back by the return ring 25, so that the second feed cam 24 is uncoupled from the first feed cam 23. Under this condition, the second feed cam 24 angularly moves by 90 degrees from the position shown in FIG. 23A, and stops there (FIG. 23B).

When the first feed cam 23 turns, the cotter pin 26-2 reaches the section C. The selective lever 28 is then operated to move the cotter pin 26-2 into the valley 24*b*-2 of the second feed cam 24. Then, the second feed cam 24 angularly moves again by 90 degrees, so that the partial gear 29 is swung by the projection 24*a*-2 of the second feed cam 24. Thereafter, the second feed cam 24 stops as shown in FIG. 23C. Thus, the first feed cam 23 completes one rotation. During a next rotation of the first feed cam 23, the projections 24*a*-3, 24*a*-4 swing the partial gear 29 in place of the projections 24*a*-1, 24*a*-2 so as to feed the sheet as described above.

Since two cotter pins are disposed on the first feed cam 23, the sheet is fed twice during one rotation of the first feed cam 23, i.e. one reciprocation of the printing head. The second feed cam 24 rotates twice to feed the sheet for six dot-lines twice, i.e. 12 dot-lines.

For the ten dot-line feeding, the second feed cam 24 is rotated by the cotter pin 26-1 under the condition shown in FIG. 23A. The feed cam 24 keeps on turning to be in the state shown in FIG. 23B similarly to the 12 dot-line feeding.

If the selective lever 28 is not operated while the cotter pin 26-2 reaches the section C from the state of FIG. 23B and that of FIG. 23C, the cotter pin 26-2 cannot get to the valley 24*b*-2 of the second feed cam. Therefore, the second feed cam 24 remains uncoupled from the first feed cam 23, and does not rotate. The partial gear 29 is swung by the projection 23*a* of the first feed cam 23 instead of the second feed cam 24.

During one reciprocation of the printing head, the sheet is fed once by the second feed cam 24, and once by the first feed cam 23. Specifically, the sheet is first fed by the 6 dot-lines and then by the 4 dot-lines, i.e. a total of 10 dot-lines.

According to the invention, the printer can feed the sheet for 4, 6, 10 or 12 dot-lines during one reciprocation of the printing head.

Figure 24:
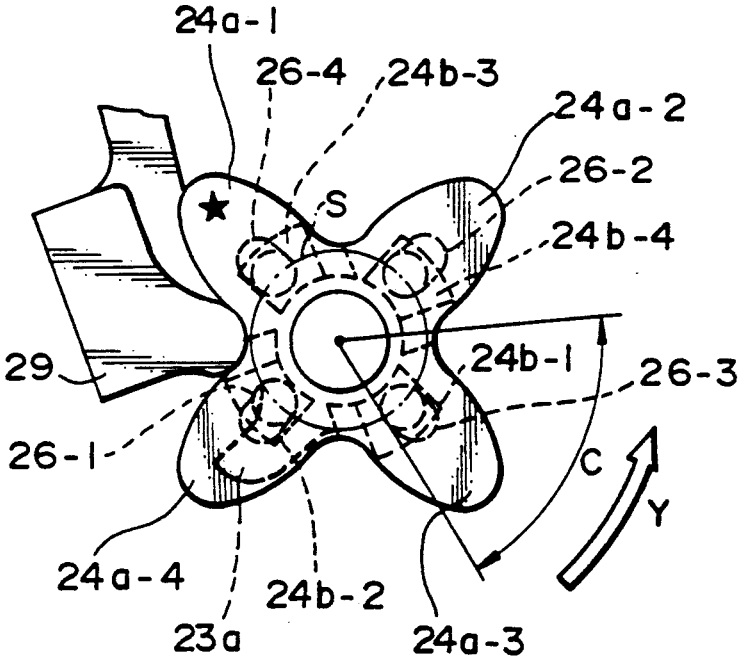
FIG. 24 shows the operation for feeding an increased amount of the sheet when four cotter pins are used.

When four cotter pins 26-1, 26-2, 26-3, 26-4 are used instead of two pins as shown in FIG. 24, the partial gear 29 can be swung by the second feed cam 24 a maximum of four times during one rotation of the first feed cam. In other words, the sheet is fed by the six dot-lines four times, i.e. a total of 24 dot-lines.

In the sheet feeder of this invention, one motor is used to drive the printing head reciprocating mechanism as well as the sheet feeding mechanism. The sheet can be automatically fed by the power of the motor and can also be fed in response to manual operation of the sheet feed roller shaft.

The sheet feeder can also vary the feeding amount of the sheet as desired, thereby advantageously meeting the demand for much smaller, lighter and less expensive printers.

What is claimed is:

1. A sheet feeder for a printer, comprising a frame, a sheet feed roller shaft, a motor and a power transmission mechanism for transmitting the power of said motor to said sheet feed roller shaft and including a sheet feed amount varying mechanism which has:

(a) a partial gear to be rotated so as to adjust the rotation of said sheet feed roller shaft;

(b) a first feed cam having a projection and a second feed cam having projections of different heights than the projection of the first feed cam so as to be selectively engaged with said partial gear, a portion of said partial gear is aligned with both of said first and second feed cams; and (c) a feed cam selecting mechanism for selectively engaging either said first or second feed cam with said partial gear, said feed cam selecting mechanism having a shaft for supporting said first and second feed cams: a plurality of cotter pins which are movable parallel to said shaft and lie between said first and second feed cams so as to be always engaged with one o said first and second feed cams and be selectively engaged with the other feed cam and which include thick and thin portions, and sliding surfaces between said thick and thin portions; a return ring coaxially supported together with said first and second feed cams and having a thick portion and a thin portion on one side thereof so as to be in contact with said sliding surfaces of said cotter pins; a selective lever which moves toward and away from the thin portion of said return ring; and an actuator for moving said selective lever to and from the thin portion of said return ring, whereby when said selective lever is in contact with the thin portion of said return ring, said cotter pins have said sliding surfaces thereof contacted with said selective lever so that said first and second feed cams are kept uncoupled and said first feed cam moves said partial gear, and when said selective lever comes away from said thin portion of said return ring, said sliding surfaces of said cotter pins come into contact with said thin portion of said return ring so that said first and second feed cams are coupled and said partial gear is turned by a projection of said second feed cam, thereby increasing the feeding amount of a sheet.

2. A sheet feeder according to claim 1, wherein said power transmission mechanism further includes a power switching mechanism for permitting manual operation of said sheet roller shaft or automatic operation by the motor, said switching mechanism having a gear rotatively supported on said sheet feed roller shaft and axially movable thereon, having a clutch surface and receiving power from the motor; a clutch wheel fixedly supported on said sheet feed roller shaft and having a surface selectively in contact with the clutch surface of said gear; a pin fixed to said frame; and said gear including a control cam opposite said clutch surface which is movable with said gear and having an engaging surface and a disengaging surface to come into contact with said pin so as to control the axial movement of said gear, whereby only when said pin is in contact with the engaging surface of said control cam, does the clutch surface of said gear come into contact with said clutch wheel so as to transmit the power of the motor to said sheet feed roller shaft, and when said pin is in contact with the disengaging surface of said control cam, said gear is out of contact with said clutch wheel so as to disconnect said sheet feed roller shaft from the motor.

3. A sheet feeder for a printer including a frame, a motor, and a sheet feed roller capable of manual operation, said sheet feeder comprising a power transmission mechanism including a power switching mechanism for temporarily disconnecting power of said motor from said sheet feed roller shaft, said power switching mechanism having: a gear rotatively supported on said sheet feed roller shaft and axially movable thereon, having a clutch surface and receiving the power from the motor; a clutch wheel fixedly supported on said sheet feed roller shaft and having a surface selectively in contact with the clutch surface of said gear; a pin fixed to said frame; and said gear including a control cam opposite said clutch surface which is movable with said gear having an engaging surface and a disengaging surface to come into contact with said pin so as to control the axial movement of said gear, whereby only when said pin is in contact with the engaging surface of said control cam, does the clutch surface of said gear come into contact with said clutch wheel so as to transmit the power of the motor to said sheet feed roller shaft, and when said pin is in contact with the disengaging surface of said control cam, said gear is out of contact with said clutch wheel so as to disconnect said sheet feed roller shaft from the motor.

4. A sheet feeder according to claim 3, wherein said power transmission mechanism includes a sheet feed amount varying mechanism which has (a) a partial gear to be rotated so as to adjust the rotation of said sheet feed roller shaft, (b) a first feed cam having a projection and a second feed cam having projections of different heights than the projection of said first feed cam so as to be selectively engaged with said partial gear, a portion of said partial gear is aligned with both of said first and second feed cams, and (c) a feed cam selecting mechanism for selectively engaging either said first or second feed cam with said partial gear, said feed cam selecting mechanism having: a shaft for supporting said first and second feed cams, a plurality of cotter pins which are movable in parallel to said shaft and lie between said first and second feed cams so as to be always engaged with one of said first and second feed cams and be selectively engaged with the other feed cam; said plurality of cotter pins each having sliding surfaces a return ring coaxially supported together with said first and second feed cams and having a thick portion and a thin portion on one side thereof so as to be in contact with said sliding surfaces of said cotter pins; a selective lever which moves toward and away from the thin portion of said return ring; and an actuator for moving said selective lever to and from the thin portion of said return ring;

whereby when said selective lever is in contact with the thin portion of said return ring, said cotter pins have said sliding surfaces thereof contacted with said selective lever so that said first and second feed cams are kept uncoupled and said first feed cam moves said partial gear, and when said selective lever comes away from said thin portion of said return ring, said sliding surfaces of said cotter pins come into contact with said thin portion of said return ring so that said first and second feed cams are coupled and said partial gear is turned by a projection of said second feed cam, thereby increasing the feeding amount of a sheet.

* * * * *